United States Patent [19]

Romine

[11] Patent Number: 4,712,647

[45] Date of Patent: Dec. 15, 1987

[54] PORTABLE AND COLLAPSIBLE PLATFORM

[76] Inventor: Richard A. Romine, 13251 Cherry St., Westminster, Calif. 92683

[21] Appl. No.: 905,118

[22] Filed: Sep. 5, 1986

[51] Int. Cl.[4] ..... E06C 1/383; E04G 3/10

[52] U.S. Cl. ..... 182/96; 182/131; 182/161

[58] Field of Search ..... 182/82, 95, 96, 150, 182/206, 130, 131, 156, 159, 160, 161, 55; 248/235

[56] References Cited

U.S. PATENT DOCUMENTS

| | | | |
|---|---|---|---|
| 77,308 | 4/1868 | Mudge | 182/214 |
| 538,145 | 4/1895 | Allen | 182/159 |
| 966,852 | 8/1910 | Norton | 182/121 |
| 1,203,313 | 10/1916 | Danke | 182/214 |
| 2,279,850 | 4/1942 | Vansickle | 248/235 |
| 3,158,225 | 11/1964 | Almgren | 248/235 |
| 3,231,043 | 1/1966 | Brown | 182/55 |
| 3,379,280 | 4/1968 | Pace | 182/96 |
| 3,552,522 | 1/1971 | Bobo | 182/150 |
| 4,029,173 | 6/1977 | Wakabayashi | 182/55 |
| 4,320,816 | 3/1982 | Callahan | 182/55 |

FOREIGN PATENT DOCUMENTS 1516915 5/1976 United Kingdom ..... 182/82

*Primary Examiner*—Reinaldo P. Machado
*Attorney, Agent, or Firm*—Albert O. Cota

[57] ABSTRACT

A portable and collapsible platform (10) designed to be hung to a set of attachment hooks (30) that are attached to a stationary structure such as a wall, beam or building eaves. The platform (10) includes a pair of inward vertical members (12), and a pair of outward vertical members (14) that are rotatably connected by a plurality of horizontal members (16) and a pair of angular support members (18). On top of the horizontal member pairs is placed a utility platform (20) that allows a worker to stand or sit. The collapsible feature of the invention is easily performed by pressing inwardly against the outward vertical members (14) until all the outward members (14), (16), (18)are nested within the inward vertical members (12). Once collapsed, the inward and outward vertical members (12), (14) are locked in place by a locking means. The platform (10) can also function as a multiple shelf by placing a platform (20) on each horizontal member pair or ladder rungs (20) may be inserted through the outward vertical members to allow the platform to function as a ladder.

21 Claims, 22 Drawing Figures

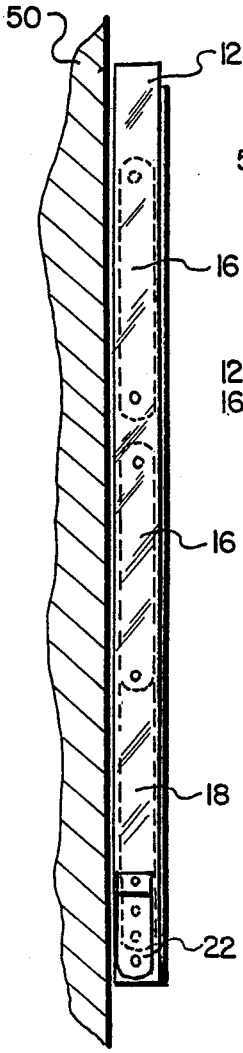
Fig.4.
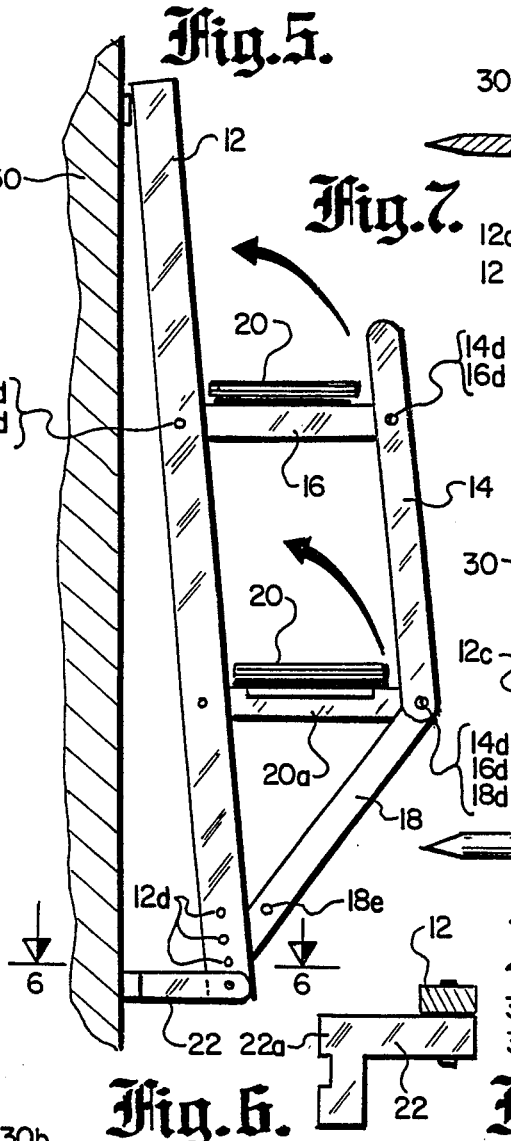
Fig.5.
Fig.6.
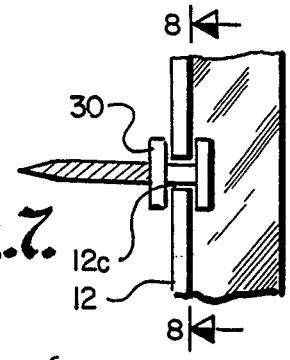
Fig.7.
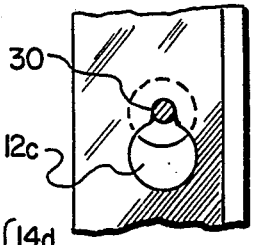
Fig.8.
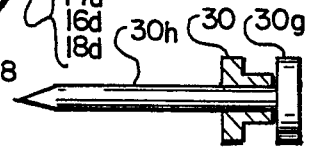
Fig.13.
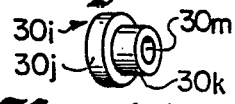
Fig.14.
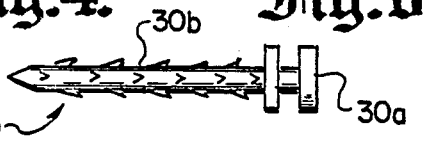
Fig.9.
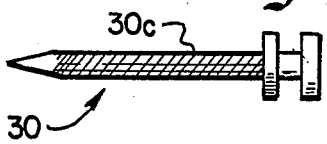
Fig.10.
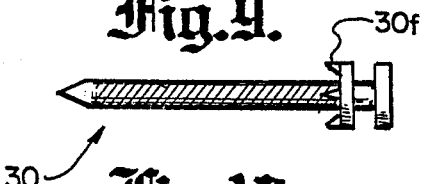
Fig.12.
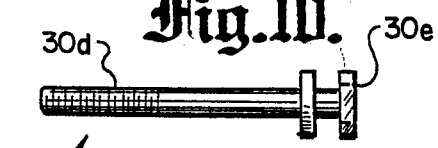
Fig.11.

PORTABLE AND COLLAPSIBLE PLATFORM

TECHNICAL FIELD

The invention pertains to the general field of scaffolds and ladders and more particularly to a utility platform that can be easily and quickly attached and detached to a stationary structure and that collapses, in place, when not in use.

BACKGROUND ART

Ladders, scaffolds and other similar structures have been in use for many years. In general, ladders fit into two categories—they are either straight ladders or A-frame ladders. In both types, the feet of the ladders are set on the ground or at the lowest practical level with the top section resting against the top of the structure to be climbed, as would apply to a straight ladder; or with the top near the structure as would be the case with the A-frame.

The scaffolds and similar structures in current use are attached to the side of a stationary structure by either permanent or temporary means and in some types, supplementary implements are included that allow the scaffold to be raised or lowered as required.

A search of the prior art did not disclose any ladders or scaffold structures that were designed to be attached or hooked to a set of attachment hooks that are permanently set into a stationary structure such as a wall or frame. Additionally, scaffolds or ladders that can be collapsed to a relatively flat surface, when in their hooked position, and/or not in use, were not found in the prior art. Although the search did not uncover any patents that read directly on the claims of the instant invention, the following U.S. patents are considered related and indicative of the state-of-the-art.

| U.S. PAT. NO. | INVENTOR | ISSUED |
|---|---|---|
| 3,552,522 | Bobo | 5 June 1971 |
| 3,231,043 | Brown | 25 January 1966 |
| 3,158,225 | Almgren | 24 November 1964 |
| 2,279,850 | Vansickle | 14 April 1942 |

The Bobo patent discloses a portable scaffold having an elongated, horizontal support that can be detachably connected to the side of a building. The scaffold includes a lateral support projecting from the horizontal support that is used to support a load such as workmen. The outer end of the lateral support is connected to an upstanding member while the inward end is supported by a stationary support.

The Brown patent discloses a portable scaffold structure for use on windows and other openings in a building. The scaffold includes a pair of elongated suspension members that have a hooked upper section designed to be hung over the ledge or sill of an open window. The lower section extents outwardly to form a support ledge on which is set an elongated, flat platform that is used to support a load.

The Almgren patent discloses a scaffold bracket that is primarily designed for concrete wall forms and that can be dismanteled after use. The bracket includes a vertical member having on its upper and lower back side an inverted U-flange. The U-flanges are sized to extend over a building wall. In the outer end of the upper U-flange is attached a horizontal workman support structure that is held in place on its inward side by a channel attached to the top of the U-flange and on its outward side by a vertical member. The lower end of the vertical member is attached to the outer end of the lower U-flange.

The Vansickle patent discloses a scaffold support adaptable for mounting on various types of wall structures. The scaffold consists of an angular bracket having a set of connecting legs which extend at right angles to each other. Extending between the connecting legs is a triangular brace. Projecting from the legs are a plurality of spurs or prongs for retaining the scaffold planking on the bracket. The legs of the bracket also includes in its inner portion a series of keyhole slots. Selectively engageable in the slots is the angularly extending end portion of a securing rod that is held by a retaining nut.

DISCLOSURE OF THE INVENTION

The portable and collapsible platform in its basic embodiment functions as a scaffold. However, with minor design modifications, it can also function as a ladder or as a multiple shelf unit. In all embodiments, the platform is designed to be easily and quickly attached or detached from a set of attachment hooks that are attached to a stationary structure such as straight or angled wall, a beam or onto the eaves of a building. When in use, the platform is in its extended position and when not in use, the platform may be easily collapsed into a relatively narrow area while remaining in its hanging position.

The platform in its scaffold configuration consists of a pair of inward vertical members and a pair of outward vertical members. These members are rotatably connected by two horizontal member sets and a pair of angular support members. On top of a horizontal member set is placed a utility platform that allows a person to stand or sit and perform work. When the platform is used as a shelf, several horizontal member pairs may be attached and a utility platform is placed on each pair. The platform may also be rotated 90-degrees to allow the platform to be attached to a horizontal stationary structure and provide a series of horizontal shelfs. When the platform is configured as a ladder, the outward vertical members include a series of ladder rungs.

When the platform is in use, it is extended away from the stationary structure. When not in use, it can be easily collapsed by first removing the utility platforms and then pressing forwardly, that is, pressing toward the stationary structure. When in the collapsed position, all the articulated members come to rest within the two inward vertical members to form a relatively narrow area. When collapsed the inward and outward vertical members are locked in place by a locking means, such as a hook lock to prevent the collapsed platform from inadvertently falling forward.

In view of the above description, it is the primary object of the invention to provide a platform that can be adapted for multiple uses, that can be easily collapsed into a narrow area when not in use and that can be easily and securely hung on and removed from a set of attachment hooks that are attached to various stationary structures.

It is also an object of the invention to provide a platform that:

- is simply constructed and yet is exceedingly rigid and stable when in use in its extended position,
- can be used without the need for a ground supporting structure, can be attached and used on partly constructed buildings or buildings which do not yet have the required structural supports to hold conventional scaffolds, can be manufactured with easily obtained materials at a relatively low cost, can be adapted for various widths as dictated by the desired width of the utility platform, is reliable, efficient, and safe to use, and is light weight, readily removable, compact and easy to store.

BRIEF DESCRIPTION OF THE DRAWINGS

FIG. 4 is a side view of the platform in the preferred embodiment shown in a collapsed position attached to a stationary structure.

FIG. 5 is a side view of the platform in the preferred embodiment shown in an extended position attached to a vertical stationary structure.

FIG. 6 is a plan view of the stabilizing standoff member.

FIG. 7 is a sectional side view of an attachment hook inserted into an inverted keyhole slot.

FIG. 8 is a front view showing an attachment hook inserted into the inverted keyhole slot.

FIG. 9 is a side view of an attachment hook having a barbed shank.

FIG. 10 is a side view of an attachment hook having a screwnail shank.

FIG. 11 is a side view of an attachment hook having a threaded shank and a head with a series of flat sides.

FIG. 12 is a side view of an attachment hook having a plurality of sharpened prongs on the inward side of the head.

FIG. 13 is a side view of an attachment hook having a two-piece head.

FIG. 14 is a perspective view of the inward side of the two-piece head shown in FIG. 13.

BEST MODE FOR CARRYING OUT THE INVENTION

Figure 1:
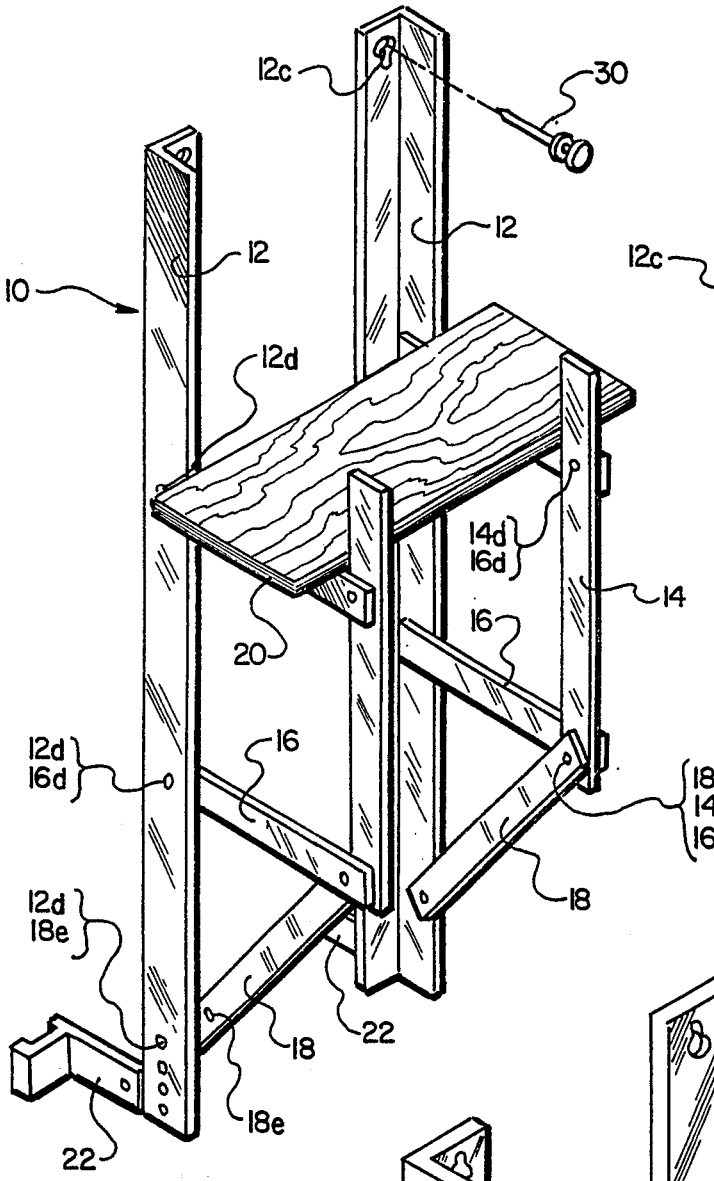
FIG. 1 is a perspective view of the portable and collapsible platform in its preferred embodiment.

The best mode for carrying out the invention is presented in terms of a preferred, second and third embodiment. All three embodiments of the portable and collapsible platform 10 are primarily designed to provide a utility platform that can be easily moved and hung on a stationary structure 50 of various configurations and that can be easily collapsed to a narrow area when not in use. The platform as described herein can function as a scaffold, ladder or as a multiple shelf unit.

The preferred embodiment, as shown in FIGS. 1 through 15, 19, 20 is comprised of the following seven major elements: a pair of inward vertical members 12, a pair of outward vertical members 14, a plurality of horizontal member pairs 16, a pair of angular support members 18, a utility platform 20, a pair of stabilizing standoff members 22 and a pair of attachment hooks 30.

Figure 2:
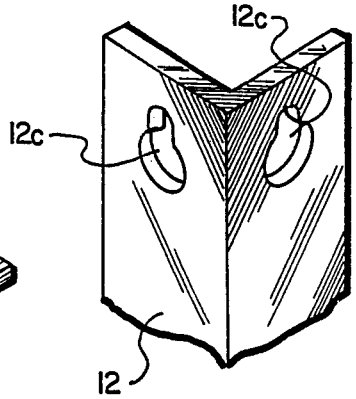
FIG. 2 is a perspective view of inverted keyhole slot.
Figure 15:
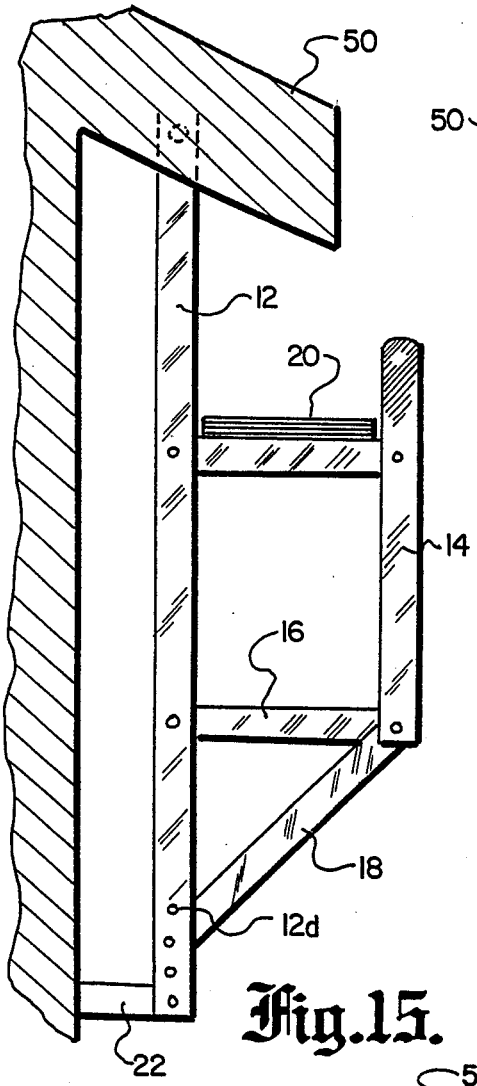
FIG. 15 is a side view of the platform in the preferred embodiment shown in an extended position attached to the eaves of a structure.

The inward vertical members 12 are constructed preferably of 90-degree angle iron. On the upward end of each member on each of its sides, is located an inverted keyhole slot **12*c* as best shown in FIG. 2. Along the sides of the members, as shown in FIGS. 1 and 15, are located a plurality of attachment bores 12*d***.

The outward vertical members 14 are constructed of straight rectangular stock preferably of wood. However, as with the remaining structural members, they may also be made from steel, aluminum, plastic or any other rigid material. The members 14 have along their side, as shown in FIGS. 1 and 5 a plurality of attachment bores **14*d*. These bores are in horizontal alignment with the attachment bores 12*d* on the respective inward vertical member 12**.

The inward vertical members 12 and outward vertical members 14 are rotatably fastened by a plurality of horizontal member pairs 16. These members are constructed of straight rectangular stock having similar dimensions and composition as the outward vertical members 14. Each member 16 has an attachment bore **16*d* on each end, with the inward bore, as shown in FIGS. 1 and 5, concentrically interfacing with the attachment bores 12*d* on the inward vertical members and where the outward attachment bores 16*d* concentrically interface with the respective horizontal attachment bores 14*d* on the outward vertical members 14**.

The final structure holding members are the angular support members 18 which are also constructed of similar dimensions and composition as the other members 12, 14 and 16. These members provide the horizontal support for the platform 10. Each of the members 18 have on their lower inward side a set of attachment/adjustment bores **18*e* that concentrically interface with one of the attachment bores 12*d* located on the lower section of the inward vertical member 12. On the upper outward side of the members 18 is an attachment bore 18*d* that concentrically interfaces respectively with the lowest attachment bore 14*d* on the outward vertical member 14 and with the outward attachment bores 16*d* on the lowest of the horizontal members 16. The three member articulated junction 18*d*, 16*d*, 14*d* is best shown in FIG. 1. The combination of the attachment/adjustment bores 14*d*, 18*e* can be selected to allow the angular support member 18 to be adjusted to compensate for a stationary structure 50** that is angled.

Each of the articulated junctions is rotatably, attached by an attachment means such as a pin or screw or other fasteners which are all well known in the art and are therefore not described.

Figure 21:
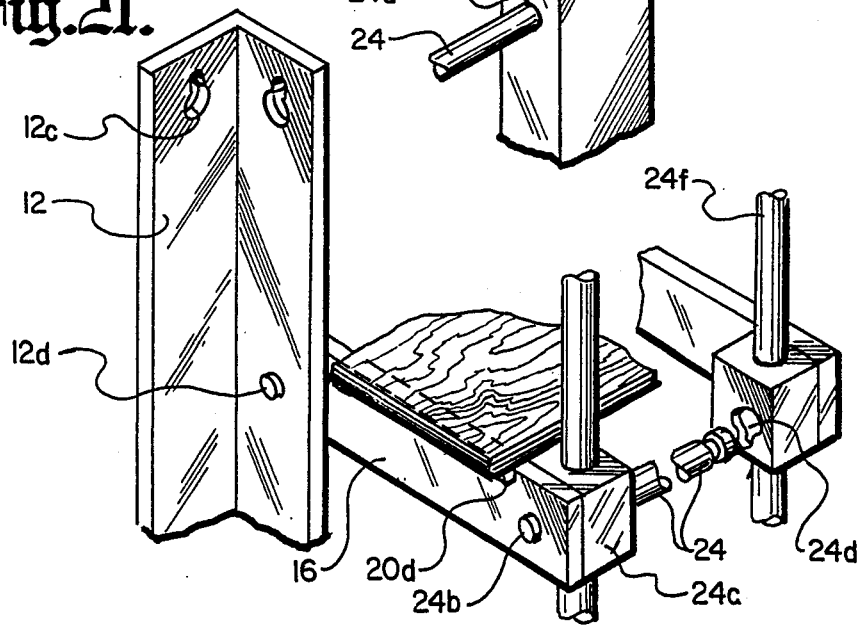
FIG. 21 is a partial perspective view of the platform in the third embodiment used as a combination ladder and platform where the work platform includes a retaining ledge.

When the invention 10 is fully assembled, a utility platform 20 is set on top of a pair of horizontal members 16 as shown in FIGS. 1, 5 and 21. The work platform 20 may be sized to fit loosely on the two members 16 or a retaining ledge 20*a*, as shown in FIGS. 5 and 21, may be added to add additional holding security. The work platform is used primarily as a surface on which a person may stand or sit while working at a height above floor or ground.

In the preferred embodiment there is also included a stabilizing standoff member 22 as shown in FIGS. 1, 5 and 6. This standoff is constructed with an outward end that has an attachment bore 22*d* that concentrically interfaces and is attached to the lowest attachment bore 12*d* on the inward vertical member. The inward side of the member 22, that is the side that contacts the stationary structure 50, is preferably constructed, as shown in FIG. 6, with a U-shaped structure that provides a double contact surface to increase and improve its holding capacity and stabilization. The contact ends of the U-shaped structure may have a roughened surface or a section of resilient material may be attached to the ends to increase its holding capability. In some instances, it may be desirable to not attach the standoff member 22 and instead, tack the bottom ends of the inward vertical member to the stationary structure. This tacking is easily accomplished by inserting and driving a nail or screw through a tack hole 12*f* located on the lower end of the inward vertical member 12 as shown in FIG. 19.

The final major element of the preferred embodiment is a pair of attachment hooks 30 as shown in FIGS. 9–14. These hooks are rigidly embedded into the stationary structure 50 and spaced in the structure to correspond to the distance between the inverted keyhole slots 12*c* on the inward vertical members 12 which, in turn, is determined by the length selected for the utility platform 20. When the hooks are in place, each section of the assembled platform 10 is raised and fastened over each of the hooks 30, as shown in FIGS. 7 and 8 and one or more platforms 20 are placed over a pair of horizontal members 16.

The utility platforms can be easily mounted by either stepping over the lower horizontal members 16 or a series of ladder rungs 24, preferably constructed of metal, may be added to the back surface of the outward vertical members 14 or other climbing means may be improvised.

Figure 19:
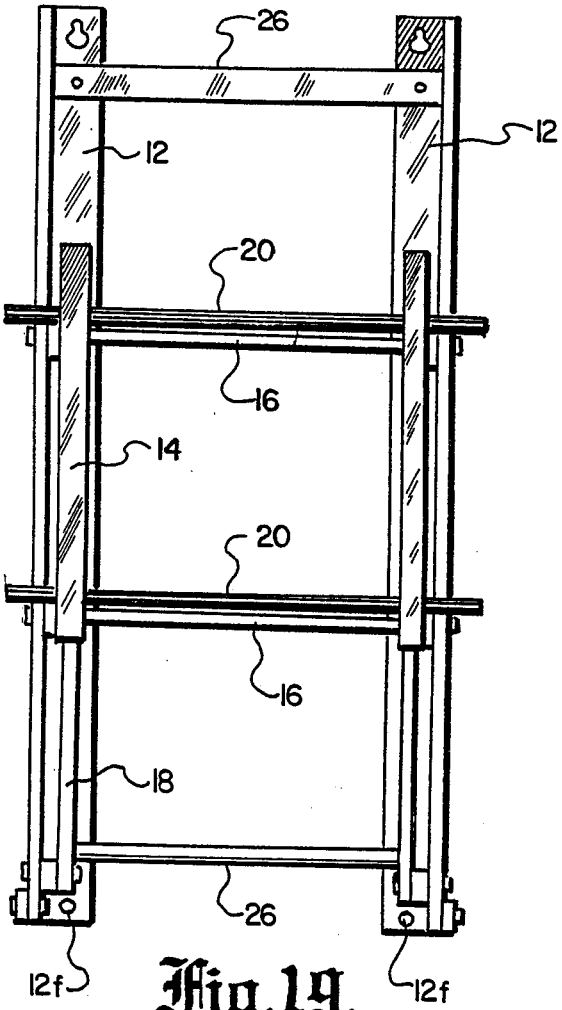
FIG. 19 is a front view of the platform in the preferred embodiment showing the articulated elements rotatably attached to the inside of a 90-degree angle iron.

When the width of the platform 10 has been established, a more permanent structure can be made by conventionally attaching one or two spacers 26 to the inward vertical members 12 as shown in FIG. 19. These spacers maintain the vertical members in a fixed width and provide additional lateral stability to the platform.

Figure 20:
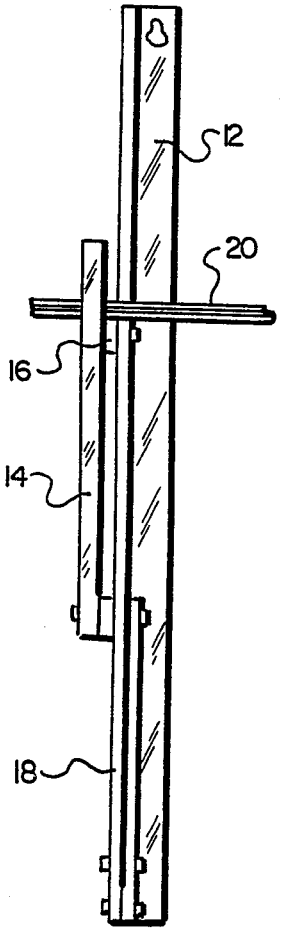
FIG. 20 is a partial front view of the platform in the preferred embodiment showing the articulated elements rotatably attached to the outside and inside of the 90-degree angle iron.

The hooked-in-place platform 10 is shown in its extended work position in FIG. 5 and in its collapsed, at rest, position in FIG. 4. In the preferred embodiment, the articulated outward, horizontal, and angular members 14, 16 18 are designed so that when they are collapsed they nest along the inside of the inward vertical members 12 as shown in FIG. 19. However, the platform can just as easily be designed to allow the articulated members to nest along the outside of the inward vertical members or in a combination as shown in FIG. 20.

The attachment hooks 30 with the double head 30*a* can be made with various shank designs. The shank design is selected to provide the best anchoring commensurate with the composition of the stationary structure 50. Some of the hook shank configurations include a barbed shank 30*b* as shown in FIG. 9, a screwnail shank 30*c* as shown in FIG. 10 and a threaded shank 30*d* with a outer head that has a series of flats 30*e* suitable for tightening with a wrench is shown in FIG. 11. Additionally, the inward side, that is the side that contacts the stationary structure can be made with a plurality of sharpened prongs 30*f* as shown in FIG. 12 to further increase the hooks anchoring capability.

An attachment hook consisting of two sections, as shown in FIGS. 13 and 14, can also be used. In this design there is an outer section 30*g* that is contiguous with the shank 30*h* and a separate inner section 30*i* as best shown in FIG. 14. The inner section is designed with a contiguous inward disk 30*j* and an outward sleeve 30*k*. The inner section 30*i* has a bore 30*m* therethrough that allows it to be slipped into the shank 30*h* so that the outward sleeve 30*k* rests against the inward side of the outer section 30*g* to thus form the double head 30*a* configuration.

Figure 3:
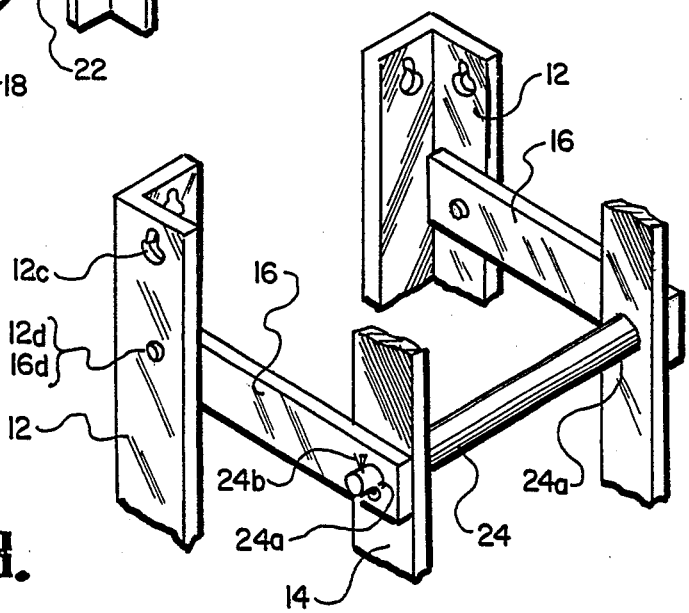
FIG. 3 is a perspective view of a safety rung added to the upper section of the preferred embodiment.

To further add to the utility and safety of the portable and collapsible platform 10, the outward vertical member 14 can be lengthened upwardly near the level of the inward vertical member 12 as shown in FIG. 3. On the upper end of each lengthened member 14 and on the outer end of the uppermost horizontal member 16 is drilled a rung bore 24*a* where both bores are concentrically aligned. A safety rung 24 is then inserted through the two rung bore sets and held in place by an attachment means such as a capped dowel 24*b* inserted through an end bore normal to the rung as also shown in FIG. 3.

Figure 16:
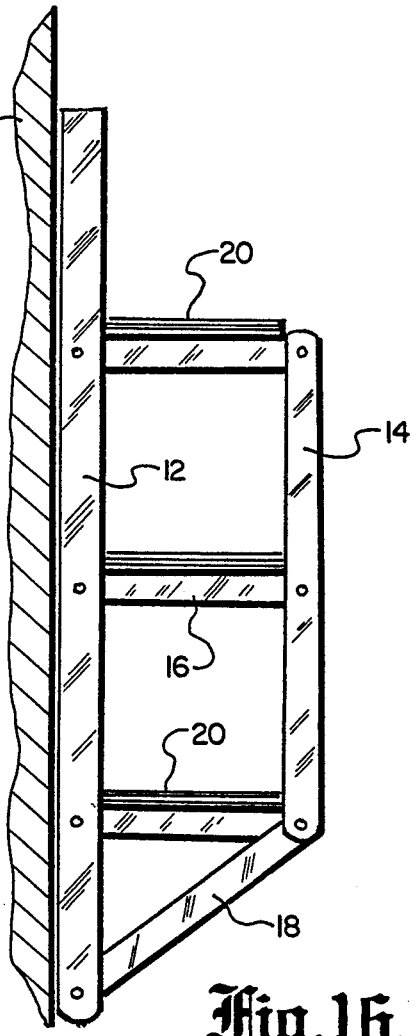
FIG. 16 is a side view of the platform in the second embodiment as used with shelving and as attached vertically to a wall.
Figure 17:
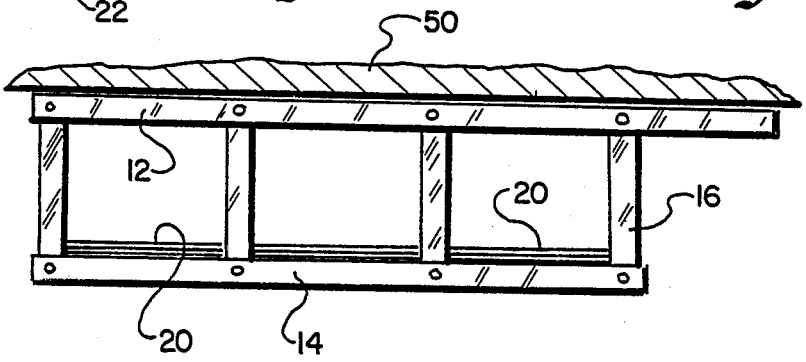
FIG. 17 is a side view of the platform in the second embodiment as used with shelving and as attached horizontally to a ceiling.
Figure 18:
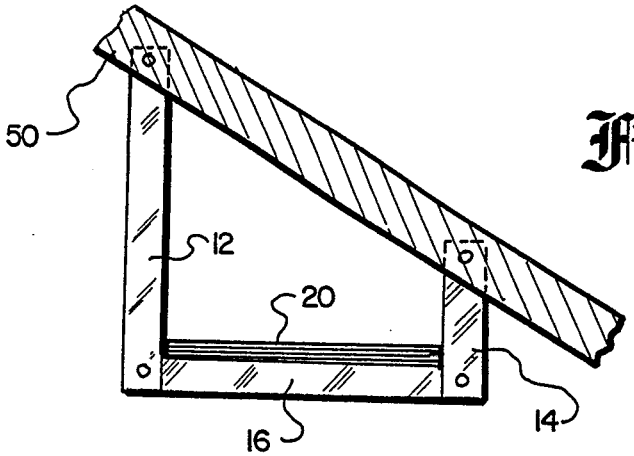
FIG. 18 is a side view of the platform in the second embodiment shown with shelving and as attached to the eaves of a structure.

The second embodiment of the portable and collapsible platform 10, as shown in FIGS. 16 through 18, is comprised of the following six major elements which were previously described in the description of the preferred embodiment: a pair of inward vertical members 12, a pair of outward vertical members 14, a plurality of horizontal members 16, a pair of angular support members 18, a plurality of utility platforms 20 and a pair of attachment hooks 30.

The second embodiment is designed to allow the invention 10 to function as a multiple shelf unit. The basic structure and mechanical configuration as similar to that described. The only significant difference is that several horizontal members 16 are added and a utility platform 20, as shown in FIG. 16, is placed on top of each horizontal member pair 16. Other modifications of the second embodiment are also shown in FIGS. 17 and 18. In FIG. 17, the inward vertical members 12 are rotated by 90-degrees, with respect to the horizontal plane, and are mounted to a horizontal stationary structure 50 by means of a set of attachment hooks 30.

In this configuration the outward set of vertical members 14 have a utility platform 20 placed therein between sets of horizontal members 16. In FIG. 18 there is shown a horizontal mounting where the inward vertical member 12 and outward vertical member 14 can be offset to allow the platform 10 to be attached between the eaves of a building.

The third embodiment of the portable and collapsible platform 10, shown in part, in FIG. 3, is comprised of the following major elements: a pair of inward vertical members 12, a pair of outward vertical members 14, a plurality of horizontal members 16 and equal plurality of ladder rungs 24.

In this third embodiment the invention functions primarily as a ladder. In the basic design, the pair of inward vertical members 12 include the previously described inverted keyhole slot 12*c* that is used to hang the assembled platform. The pair of outward vertical members 14 have a length that is equal to the length of the inward vertical members 12. Along the side of the members 14 is a plurality of rung bores 24*a* that are in horizontal alignment with the attachment bores 12*d* on the inward vertical member. A plurality of horizontal member pairs 16 are provided with each member having an attachment bore 16*d* on its inward end that concentrically interfaces with the respective attachment bore 12*d* on the inward vertical members.

On the outward end of each horizontal member 16 is a rung bore 24*a* that interfaces with the respective rung bores on the outward vertical members. To complete the ladder configuration, a ladder rung 24 is rotatably inserted through each pair of rung bore sets 24*a*.

A modification of the ladder configuration is shown in FIG. 21. The modified design includes a set of rung standoff 24*c* that have a horizontal bore 24*d* and an offset vertical bore 24*e*. These standoffs are rotatably attached to the outer end of each horizontal member 16. A ladder rung 24 is rotatably inserted into each horizontal bore 24*d* and likewise a vertical ladder grip 24*p* is attached rigidly into each of the aligned vertical bores 24*e*. When this ladder configuration is collapsed, the standoff 24*c* rotates about the ladder rung 24 and horizontal member 16 and moves vertically inward between a pair of inward vertical members 12.

As also shown in FIG. 21, a utility platform 20 may be set between selected horizontal member 16 pairs to further add to the utility of this embodiment.

Figure 22:
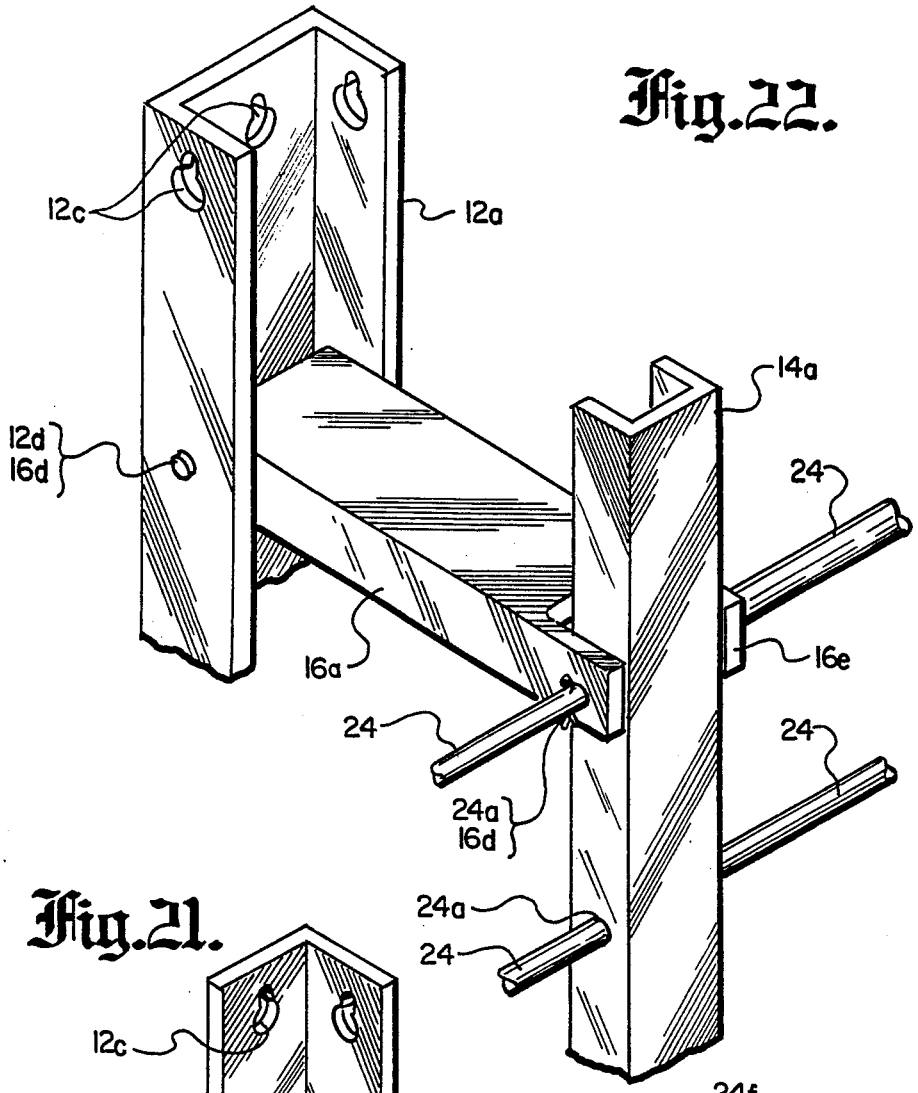
FIG. 22 is a partial perspective view of a platform that utilizes a channel iron inward vertical member, a channeled outward vertical member and a bifurcated horizontal member that rotatably connects the two vertical members.

The final discussion covering the invention 10 is shown in FIG. 22 and is applicable to any of the three embodiments previously described. This final design embodiment consists of a pair of inward vertical members 12*a* in a channel configuration. The channels have on their upward end the previously described inverted keyhole slot and a plurality of attachment bores 12*d* along their two parallel sides.

A pair of outward vertical members 14*a* also in a channel configuration but with a width that is preferably less than equal to or greater than the width of the inward vertical members 12*a* are also included. Each of these outward vertical members have a plurality of attachment bores 16*d* that are in horizontal alignment with the attachment bores 12*d* on the inward vertical members 12*b*. The two vertical members 12*a*, 14*a* are rotatably held in place by a plurality of horizontal member 16*a*. Each horizontal member has on its inward side a bore 16*d* that concentrically interfaces with the attachment bores 12*d* in the inward vertical member. The outward side of the hoirzontal member 16*a* is configured with a bifurcated section 16*e* that has an attachment bore 16*d* on each of its parallel sides. The bifurcated opening is sized to accept and rotatably attach the outward vertical member 12*a*. The channel configuration of this design allows the bifurcated horizontal member 16*a* and the outward vertical member 14*a* to be collapsed into the channel of the inward vertical member 12*a*. The outward vertical members 14*a* can also be dimensioned to be equal to or greater than the inward vertical members 12*a*. When the members 14*a* are equal the channel ends abutt the channel ends of the members 12*a* and when they are greater, they nest along the outside of the member 12*a* channel sides.

As also shown in FIG. 22, only one section or side of the platform 10 may be used to function as a ladder. In this configuration, the bifurcated end 16*e* and the outward vertical member 14*a* have a set of concentric rung bores 24*a*. Into this bore set is inserted a rung 24 having ends that extend a sufficient distance from the sides of the bifurcated end to allow a person to climb. The remaining lower ladder rungs would be inserted through a series of rung bores 24*a* extending downwardly along the sides of the outward vertical member 14*a*.

In another modification (not shown) of this third embodiment, the inward vertical members 12*a* and the outer vertical members 14*a* are constructed of a channel configuration having similar dimensions. When the two members are extended, a dust cover can be conventionally attached to the backside of a member set and on each side, to thus form an enclosed dust free shelf enclosure. Additionally, a door can be hingedly attached to the front side of the other member set to further add to the utility.

While the invention has been described in complete detail and pictorially shown in the accompanying drawings, it is not to be limited to such details, since many changes and modifications may be made to the invention without departing from the spirit and scope thereof. For example, the structural members can be configured in other structural shapes and made of iron, aluminum, plastic or fiber composites. Hence, it is described to cover any and all modifications and forms which may come within the language and scope of the appended claims.

I claim:

1. A portable and collapsible platform comprising:

(a) a pair of inward vertical members having on their upward end a means for fastening said vertical members to a stationary structure and having along their outward side a plurality of attachment bores, (b) a pair of outward vertical members having along their side a plurality of attachment bores in horizontal alignment with the respective attachment bores on said pair of inward vertical members, (c) a plurality of horizontal member pairs each having an attachment bore on each end where inward attachment bores concentrically interface with the attachment bores on said inward vertical members and where outward attachment bores concentrically interface with the respective horizontal attachment bores on said outward vertical members, (d) a pair of angular support members each having on their lower inward side an attachment bore that concentrically interfaces respectively with an attachment bore located on lower section of said inward vertical member and having on their upper outward side an attachment bore that concentrically interfaces respectively with the lowest outward attachment bores on said outward vertical members and with the outward attachment bores on the lowest of said horizontal members, (e) means to rotatably attach each of the concentric bore sets, and (f) a utility platform sized to rest on the top surface of a selected pair of said horizontal members where said platform allows a person to stand or sit while working at a height above the floor or ground.

2. The platform as specified in claim 1 wherein said inward vertical member is comprised of a 90-degree angle iron with each upper side of said angle iron having an inverted keyhole slot.

3. The platform as specified in claim 2 further comprising a set of attachment hooks that are rigidly embedded into the stationary structure and spaced in the structure to correspond to the distance between the inverted keyhole slots on said inward vertical members.

4. The platform as specified in claim 3 wherein said means for fastening said inward vertical member to a stationary structure is accomplished by placing said inverted keyhole slots, located on said inward vertical member over said attachment hooks.

5. The platform as specified in claim 1 wherein said outward vertical members and rotatably attached horizontal and angular members can be collapsed to allow said members to nest along the sides of said inward vertical members.

6. The platform as specified in claim 1 wherein said inward vertical member having on its lower side a set of adjustment bores that allow said angular support member to be adjusted to compensate for an angle stationary structure.

7. The platform as specified in claim 1 further comprising a pair of stabilizing standoff members having an inward end and an outward end with the outward end having an attachment bore that is rotatably attached to the lowest adjustment bore on said inward vertical member and where inward side has a surface configured to contact the stationary structure.

8. The platform as specified in claim 7 wherein said stabilizing standoff member has a U-shaped structure on the inward end that provides a double contact surface to improve its holding capacity and stabilization.

9. The platform as specified in claim 1 wherein said attachment hook has a double head and a barbed shank.

10. The platform as specified in claim 1 wherein said attachment hook has a double head and a screwnail shank.

11. The platform as specified in claim 1 wherein said attachment hook has a plurality of sharpened prongs on the inward side of the double head.

12. The platform as specified in claim 1 wherein said attachment hook has a double head with its outward section having a plurality of flats and a threaded shank.

13. The platform as specified in claim 1 wherein said attachment hook is comprised of an attachment hook having two separate sections: an outer section that is contiguous with the shank and an inner section comprised of a contiguous inward disk and outward sleeve with said inner section having a bore therethrough that allows said inner section to be slipped into the shank so that the surface of the outward sleeve rests against the inward side of the outer section to thus from a double head configuration.

14. The platform as specified in claim 1 wherein said outward vertical members are lengthened upwardly with each of said members having a rung bore into which is inserted a safety rung.

15. The platform as specified in claim 1 wherein on top of each horizontal member set is placed a utility platform that allows said platform to function as a multiple shelf unit.

16. The platform as specified in claim 1 wherein said inward vertical members are rotated by 90-degrees and are mounted to a horizontal stationary structure with the outward vertical member set having a utility platform placed therein to allow said collapsible platform to serve as a horizontally oriented shelf.

17. A portable and collapsible platform comprising:

(a) a pair of inward vertical members having on their upward end a means for fastening said vertical members to a stationary structure and having along their side a plurality of attachment bores, (b) a pair of outward vertical members that have a length equal to the length of said inward vertical members and having along their side a plurality of rung bores in horizontal alignment with the attachment bores on said inward vertical members, (c) a plurality of horizontal member pairs with each member having an attachment bore on its inward end that concentrically interfaces with the respective attachment bores on said inward vertical members and having a rung bore on its outward end that concentrically interface with the respective rung bores on said outward vertical members, and (d) a ladder rung rotatably inserted into each pair of rung bore sets such that said platform serves as a ladder.

18. A portable and collapsible platform comprising:

(a) a pair of inward vertical members in a channel configuration having on their upward end a means for fastening said vertical members to a stationary structure and having a plurality of attachment bores along their two parallel sides, (b) a pair of outward vertical members having a width that is less than the width of said inward vertical members and each having a plurality of attachment bores in horizontal alignment with the attachment bores on said inward vertical members, and (c) a plurality of horizontal member pairs each having on their inward side a bore that concentrically interfaces with the attachment bores on said inward vertical member and having on their outward end a bifurcated section having an attachment bore on each side where the bifurcated opening is sized to accept and rotatably attach the end of said outward vertical member and where the channel configuration allows said bifurcated horizontal member and said outward vertical member to be collapsed into the channel of said inward vertical member.

19. The platform as specified in claims 17 or 18 further comprising a means for locking said inward vertical member to outward vertical member when said platform is in the collapsed configuration.

20. The portable and collapsible platform as specified in claims 17 or 18 further comprising a spacer that is attached between a pair of said inward vertical members to maintain said vertical members in the selected fixed width.

21. The platform as specified in claim 18 wherein a single platform section consisting of one each of said vertical member, outward vertical member and horizontal member with the bifurcated end of said horizontal member and the upper end of said outward vertical member having a set of concentric rung bores into which is inserted a ladder rung having sides that extend beyond the sides of the bifurcated ends to allow a person to climb on said rungs and with said outward vertical member further having a series of said rung bores extending downwardly along its side where into each of said bores is inserted a ladder rung.

* * * * *